US008267755B2

(12) United States Patent
Adams et al.

(10) Patent No.: US 8,267,755 B2
(45) Date of Patent: Sep. 18, 2012

(54) ELASTIC DRIVE DISK FOR A COIN HANDLING MACHINE

(75) Inventors: Thomas P. Adams, Oconomowoc, WI (US); Richard P. Uecker, Hartford, WI (US); Daniel J. Folger, Oconomowoc, WI (US); Robert L. Zwieg, Watertown, WI (US)

(73) Assignee: Talaris Inc., Watertown, WI (US)

( * ) Notice: Subject to any disclaimer, the term of this patent is extended or adjusted under 35 U.S.C. 154(b) by 0 days.

(21) Appl. No.: 12/674,946

(22) PCT Filed: Aug. 27, 2008

(86) PCT No.: PCT/US2008/074418

§ 371 (c)(1),
(2), (4) Date: Feb. 24, 2010

(87) PCT Pub. No.: WO2009/032679

PCT Pub. Date: Mar. 12, 2009

(65) Prior Publication Data

US 2011/0189932 A1 Aug. 4, 2011

Related U.S. Application Data

(60) Provisional application No. 60/966,964, filed on Aug. 31, 2007.

(51) Int. Cl.
*G07D 3/00* (2006.01)

(52) U.S. Cl. ..... 453/12; 453/6; 453/10

(58) Field of Classification Search ..... 453/6, 10, 453/12, 13, 33, 34, 35, 49, 57
See application file for complete search history.

(56) References Cited

U.S. PATENT DOCUMENTS 4,433,787 A * 2/1984 Cook et al. ..... 211/5
6,729,461 B2 * 5/2004 Brandle et al. ..... 194/317
6,772,870 B2 * 8/2004 Sugai et al. ..... 194/217

* cited by examiner

*Primary Examiner* — Jeffrey Shapiro
(74) *Attorney, Agent, or Firm* — Boyle Fredrickson, S.C.

(57) ABSTRACT

An elastic coin moving disk assembly (23) for moving coins across a coin sorting and coin collection member (13) in a coin handling machine (10), in which the coin sorting and coin collection member (13) has openings (28) of varying size to receive coins (14) of respective denominations, the coin moving disk assembly (23) having an annular disk body with a groove (32) and an outer rim (35) having a cavity (33) in a bottom surface; and a fin ring (39) molded into the cavity (33) in the bottom surface, the fin ring (39) comprising planar fingers (42) extending downward and substantially perpendicular to the bottom surface of the rim (35) when first manufactured, and later taking on an angular "set" after an initial break-in period, which is compensated for by a user-removable shim (43).

8 Claims, 5 Drawing Sheets

FIG. 5
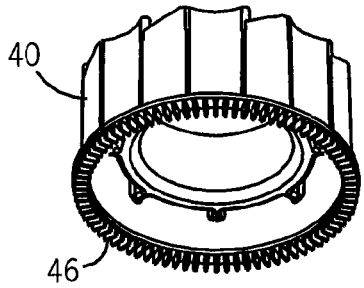
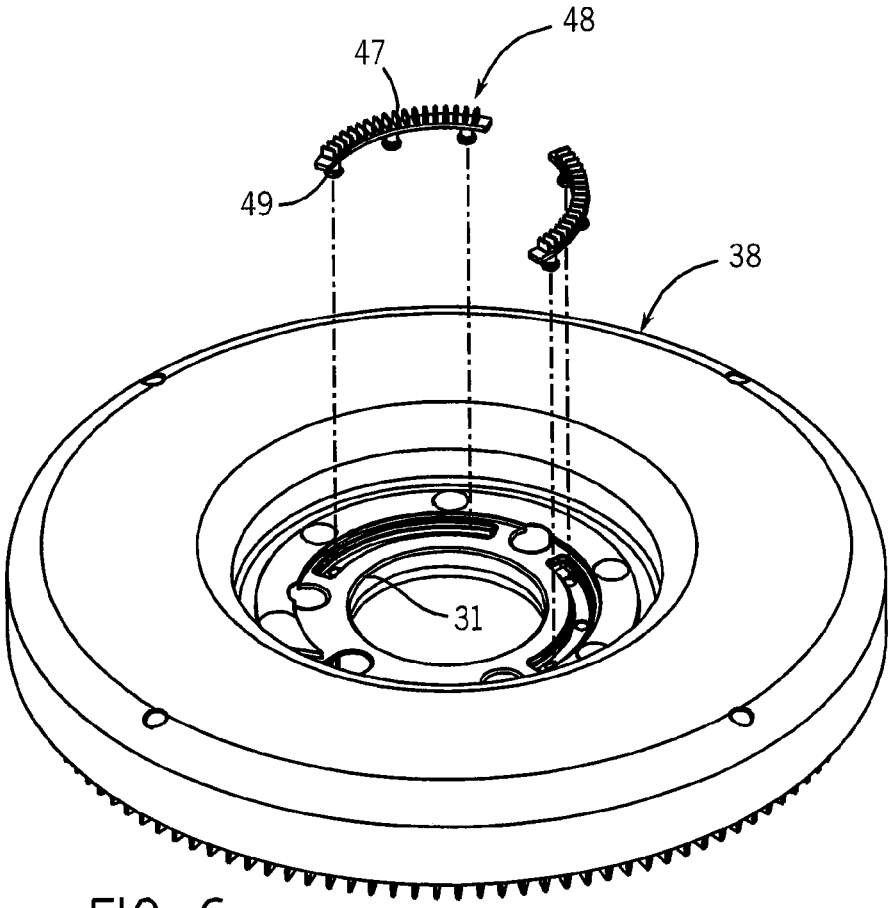
FIG. 6

ELASTIC DRIVE DISK FOR A COIN HANDLING MACHINE

CROSS REFERENCE TO RELATED APPLICATION

The benefit of priority based on U.S. Prov. Appl. No. 60/966,964, filed Aug. 31, 2007, is claimed herein.

TECHNICAL FIELD

The present invention relates to a coin handling machine for counting and obtaining a valuation for a batch of coins of mixed denominations, and more particularly the invention relates to a coin moving disk for moving coins through the machine with positive control.

BACKGROUND ART

Brandle et al., U.S. Pat. No. 6,729,461, discloses a coin sorter having a circular sorting track with an outside reference edge. The coins are moved by a coin moving disk with fingers that press down on and push the coin along its path.

The coin moving disk includes a plurality of fins or fingers which push the coins along a coin sorting path over the sorting openings. The coin moving disk, including its fins, is made of a light-transmissive material, such as acrylic. The coin moving disk may be clear or transparent, or it may be milky in color and translucent.

The fins of this prior art disk, are also referred to as "webs." Briefly, they are aligned along radii of the coin moving member, and have a length equal to about the last 30% of the radius from the center of the circular coin moving member.

There were several problems concerning the coin moving disk of the prior art. The fins did not always grip the coins as well as desired. The fins could be subject to a "set" in which the fins become bent at a slight angle from perpendicular after repetitive use during a break-in period.

The coin moving disk was susceptible to wear and servicing. In one case, in the prior art, the disk had to be adjusted by having a service technician make a service call to remove a particular type of shim due to the "set" phenomena described above. The present invention is designed to provide a user-serviceable shim instead.

SUMMARY OF THE INVENTION

The invention will enable one to provide for better control of moving coins. The invention will also lessen the effects of a "set" in which the fins become bent at a slight angle from perpendicular after repetitive use during a break-in period.

The invention will make the coin moving disk less susceptible to wear and servicing.

With the invention, assembly of the coin moving disk easier and more secure and not susceptible to user disassembly in the field.

In a further aspect, the invention provides clearance for the coins to rotate, allowing them to be tipped in opposite directions depending upon whether they are to be offsorted or collected through a sorting or collection opening. This necessitates reducing the fin size.

In a further aspect, the invention provides clearance for a new type of optical coin detection system that fits beneath the coin moving disk rather than extending above it to provide a beam of illumination through the moving disk, as was practiced in the prior art machine cited above.

In a further aspect, the invention provides improved bonding of the parts of an assembly of the parts of the coin moving disk.

In a further aspect, the invention provides improved handling of smaller coins down to 15 mm in diameter.

In the following description, reference is made to the accompanying drawings, which form a part hereof, and which illustrate examples of the invention, but such examples are not the extent of the invention, which is reserved for the claims.

BRIEF DESCRIPTION OF THE DRAWINGS

FIGS. 5 and 6 are a bottom and top perspective view of two parts of the coin moving disk assembly in FIG. 4;

DETAILED DESCRIPTION

Figure 1:
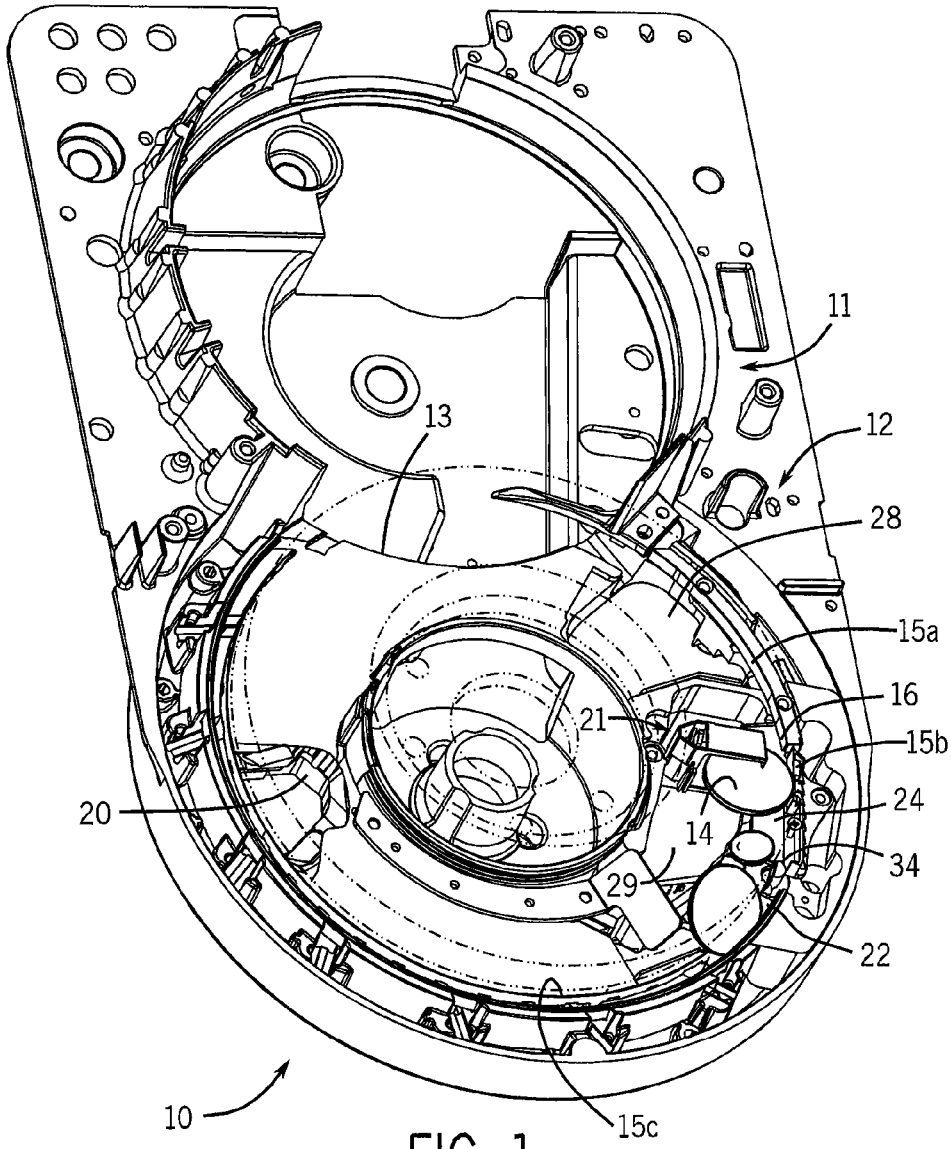
FIG. 1 is a perspective view of a coin sorting assembly with parts removed.
Figure 8:
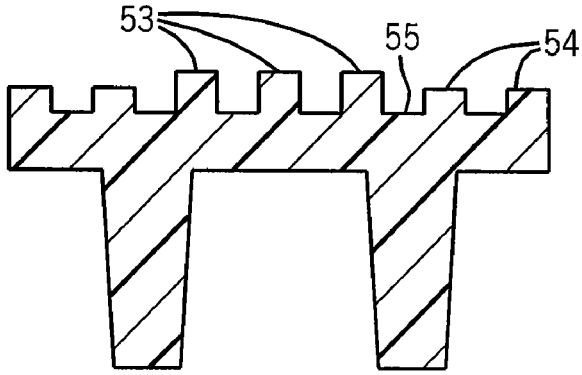
FIG. 8 is a sectional view taken in the plane indicated by line 8-8 in FIG. 7.

Referring to FIG. 1, a coin handling machine 10 of the present invention includes a feeding disk (not shown) of a type known in Brandle, U.S. Pat. No. 6,729,461, which would reside in one end loop of a frame 11 having an overall shape of a figure-8. In the other end loop 15 of the frame is a coin collection assembly 12 for checking the validity of coins and counting them for valuation purposes. The coin collection assembly includes a coin sorting and coin collection plate 13 with offsort openings 22, 28 and 29 and with a collection opening 20 for collecting coins that are not offsorted. In other embodiments, there can be multiple collection openings for sorting coins of different denominations before collection.

In this embodiment, valid coins of all denominations are moved by the coin moving disk 23 to a collection opening 20 after passing a coin sensor assembly 21 and an offsorting opening 22. The coins 14 are directed to, and collected in, coin bins of a type disclosed in a copending PCT Appl. No. PCT/US07/017969 of Gunst et al., entitled "Coin Collecting Machine and Coin Bin," and designating the United States of America. First, one bin is filled with mixed denominations, and then a second bin is filled with mixed denominations with the coins having been counted and valued with the coin sensor assembly 21 of the present invention.

The present invention is also applicable to an embodiment having coin sorting openings for receiving valid coins of respective sizes corresponding to different denominations, either with or without coin detectors at the openings.

The sensor assembly 21 forms a coin track 24 passing along an outside reference edge that is formed by base member arcuate portion 15*a*, an edge sensor assembly 15*b* and an upstanding rail 15*c*. On the coin sorting and coin collection plate 13, the coin track 24 has a width defined by the largest size of coin to be processed by the machine 10. Some additional offsorting slots 28 and 29 have been provided for coins not in position along the reference edge. A coin sensor assembly 21 includes a reflective-type optical sensor and is positioned to the inside of a coin track 14, ahead of the coin collecting opening 20. A light source is now positioned lower than the coin track 24 rather than above it. The top flange portion of the coin sensor assembly 21 has a reflector on its underside positioned above the coin track 24.

Figure 2:
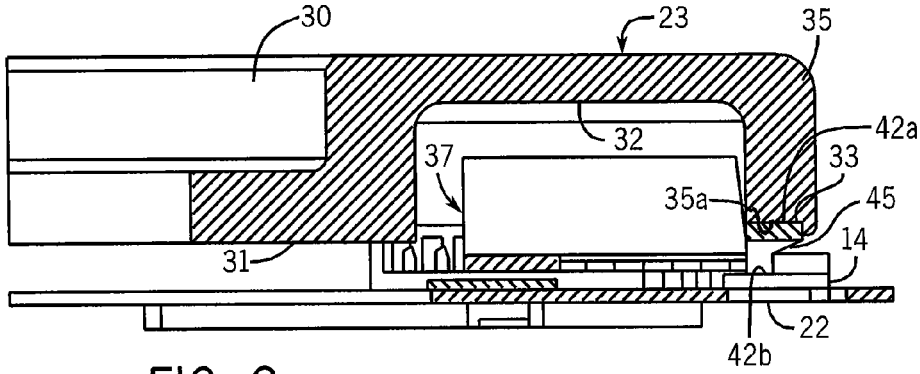
FIG. 2 is a detail sectional view of a portion of the apparatus seen in FIG. 1.

FIG. 2 shows that the coin moving disk 23 has been modified to provide an underneath groove 32 for allowing the coin moving disk 23 to pass over the top of the coin sensor assembly 21 (FIG. 1) and to pass by the coin sensor assembly 21 on opposite sides. The coin moving disk 23 is shown as transparent for illustration purposes only, and in practice can be transparent, semi-opaque including translucent, or opaque as there is no longer a requirement to shine a light source through the coin moving disk 23. The fins or fingers 42 (FIG. 2) of the coin moving disk 23 have been made much narrower than in the prior art and now press down on the outside portions of the coins 14 near the reference edge. This has the effect of tipping up the inside edges of the coins 14 off the coin track 24, as seen in FIG. 1, so that the coins are cantilevered over the inside edge of the coin track 24.

As seen in FIGS. 1 and 2, the offsort opening 22 is positioned just after a coin diverter 34 for diverting invalid coins when detected by the coin sensor assembly 21. When an invalid coin is detected by the coin sensor assembly 21, a signal is sent to operate the rotary solenoid-driven coin diverter 34. The diverter 34 has a shaft with a semicircular section and a flat on one side, and when rotated, a semicircular portion projects into the coin track and pushes a coin off of the reference edge and off of a narrow rail portion of the coin track 14. This causes the coin 14 to tip up as it enters the offsort opening 22, as shown in FIG. 1. Further description is provided in a U.S. patent application Ser. No. 11/894,012, filed Aug. 17, 2007, and entitled "Method and Apparatus for Offsorting Coins in a Coin Handling Machine," the full disclosure of which is incorporated herein by reference.

For smaller coins this is enough for the coin to fall through the offsort opening 22, which is shown as an elongated, curved slot extending from a leading end to a trailing end. The offsort opening 22 is not as wide as the coins of the smallest size to be sorted. For larger coins, there must be further assistance to urge the coin into the offsort opening 22.

FIG. 2 shows a portion of an annular disk body 38 having a groove 32 formed and positioned between an outer rim 35 portion and a hub 31 forming a central depression and opening downwardly to receive a coin sensor assembly (not shown) and deflector 37 (FIG. 2) which project upwardly into the groove 32, the outer rim portion 35 having a cavity 33 in a bottom surface.

As further seen in FIG. 2, a fin ring 39 is molded into the cavity 33 in the bottom surface, the fin ring 39 comprising substantially planar fingers 42 extending downward and substantially perpendicular to the bottom surface of the rim portion 35, the fingers 42 being spaced around the rim portion of the fin ring 39, each of the fingers 42 having a base 42*a* disposed in the cavity in the bottom surface 35*a* of the rim 35 and each of the fingers 42 having a bottom edge 42*b* that is substantially narrower in width than the base 42*a* of each finger 44, the bottom edge 42*b* also being narrower in width than a diameter of the smallest coin to be processed, so that each finger 42 can press on a portion of the coin 14 to tip an edge portion of a coin 14 into an opening 22 for receiving the coin 14.

Figure 4:
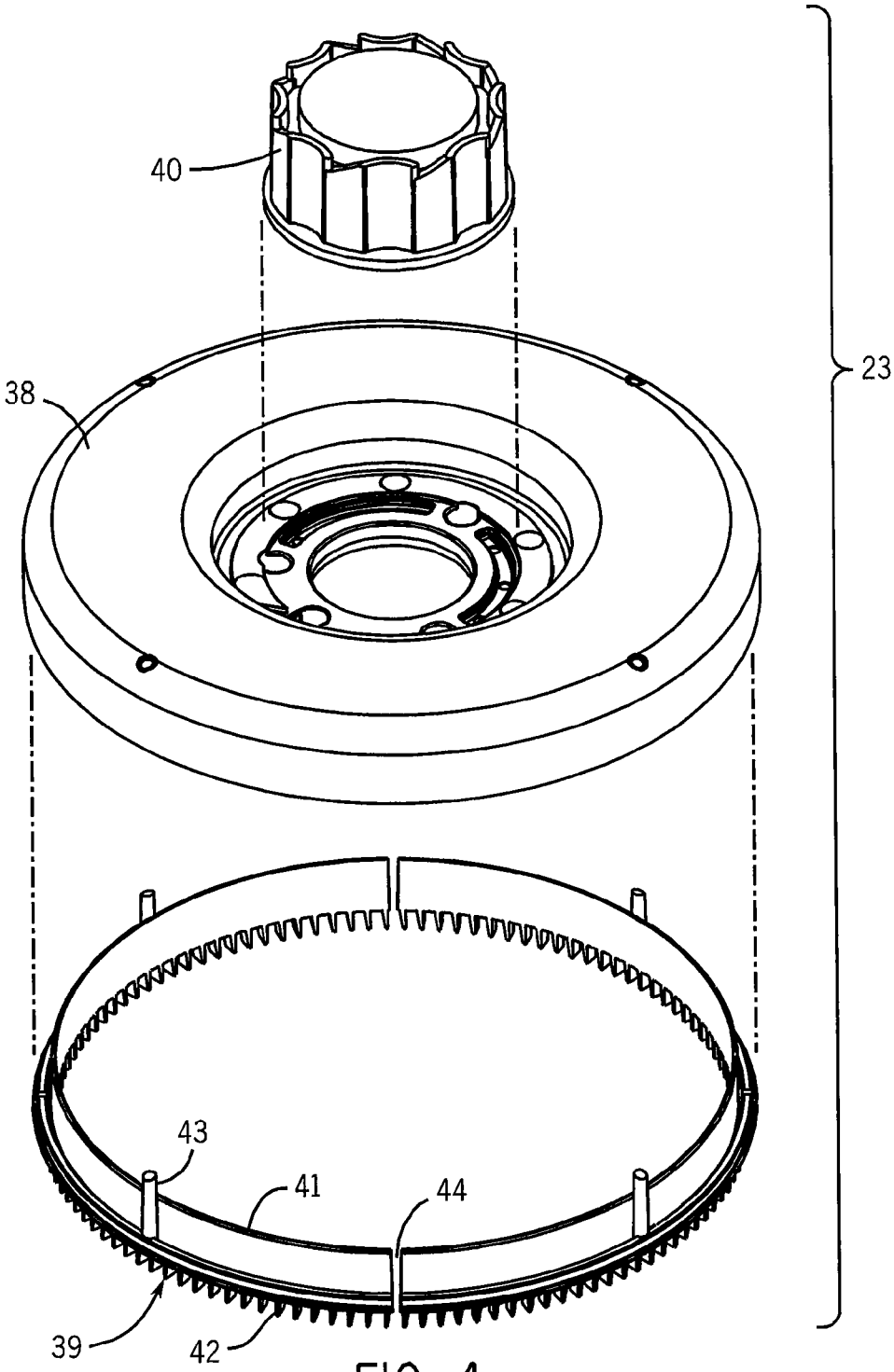
FIG. 4 is exploded view in perspective of the coin moving disk assembly of FIGS. 1, 2 and 3.

FIG. 4 shows an assembly of the coin moving disk 23 of the present invention. The assembly includes the disk body 38, the fin ring 39 and a control knob 40. The disk body is made of relatively stiff material, a glass-filled polycarbonate. The fin ring 39 is made of polyurethane and this part is overmolded onto the bottom of the disk body 38 to provide an integral assembly in which the bond between the fin ring 39 and disk body 38 is improved over the prior art. In the prior art, a fin ring was adhered to a disk body using a double-sided adhesive tape. In operation, this bond was somewhat flexible, with the result that the fins 42, which are manufactured to be perpendicular to the base 41 of the fin ring 39, became set at a slight acute angle after some initial repetitive use in processing coins. The present technique of overmolding to be described below provides a stiffer bond to reduce the effect of "setting" in the fins 42.

Figure 3:
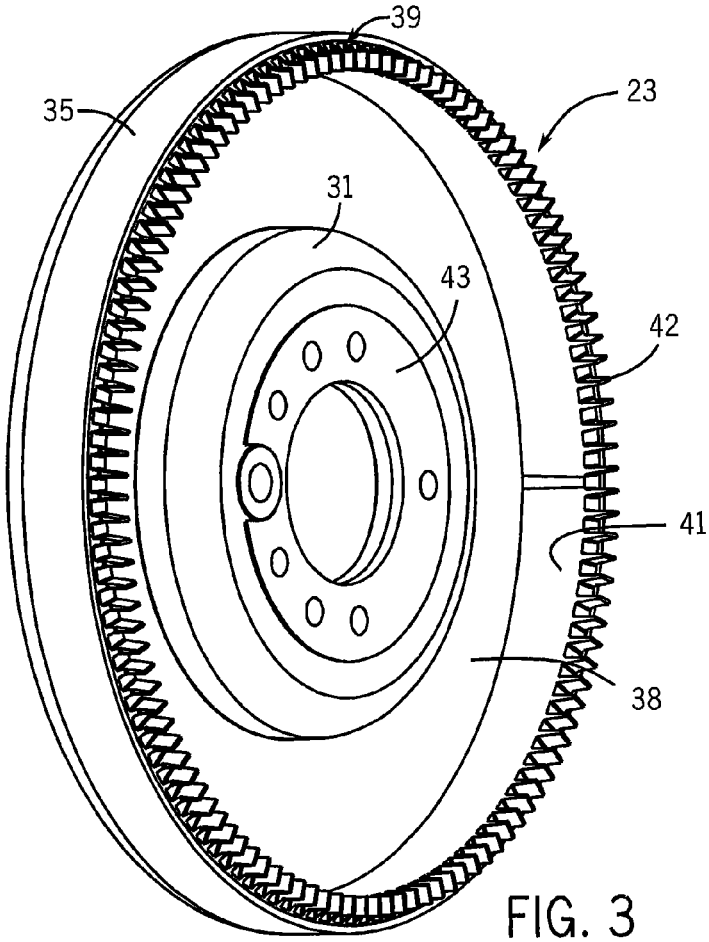
FIG. 3 is a bottom perspective view of a coin moving disk assembly seen in FIG. 1.

As shown in FIG. 3, a shim 43 is provided in the coin moving disk assembly 23, beneath a central opening in the hub 35 and is held in place by a removable adhesive. The shim 43 is annular and planar in shape to provide a small gap between the disk assembly and a supporting structure. The shim is suitable for removal by a user after an initial break-in period of operation to compensate for a gap between the bottom edges 42*b* of the fingers 42 and a surface of the coin sorting and coin collection plate 13 resulting from an initial period of operation of the coin handling machine. The fins have an original clearance of 0.001 inches to 0.005 inches from the coin collection plate 13. After the initial break-in period the shim 43, held in place using a removable adhesive, can be removed by a user and this lowers the coin moving disk assembly 23 relative to the plate 13, which compensates for the fins 42 becoming less perpendicular to the sorting plate 13. Removing the shim 43 restores the 0.001 inch to 0.005 inch clearance.

In the overmolding technique, the disk body 38 is made first and then inverted and placed in a mold (not shown), where polyurethane is filled into a circular groove 35*a* and other cavities in the disk body 38. The overmold is shaped to form the fin ring 39 seen in FIGS. 3 and 4. The showing in FIG. 3 is for illustration of the shape of the fin ring 39; the fin ring 39 would not, in practice, be removed from the disk body 38 after the overmolding has been performed. The fin ring 39 includes a ring-shaped base 41, studs 43 and narrow vertical slots for engaging complementary portions of the bottom of the disk body. This provides a solid, more rigid bond between the fin ring 39 and the disk body 38 than was possible by adhering the ring with double-sided adhesive tape in the manner of the prior art. After filling the mold with the polyurethane material, the material is cured and the disk assembly 38, 39 without the control knob 40 is removed from the mold.

The overmolding technique improves the control of the radial dimensional size, the run-out and shrinkage factor. It also improves control of the height dimensions of the disk assembly 23. It provides a single part for stocking purposes. The fins 42 in the fin ring 39 are narrower and thicker than in the prior art to provide greater stiffness and better grip on the coins. The fins 42 have a taper 45 (FIG. 2) along an outside edge and a clearance between the outside edge of the collection opening 20 that is sufficient to allow the coins to tip up when being collected. The fins 42 also have a clearance between the inside edge and the inside edge of the offsorting opening 22 that is sufficient to allow the coins 14 to be tipped up in an opposite direction for offsorting through opening 22 as illustrated in FIG. 1.

Figure 7:
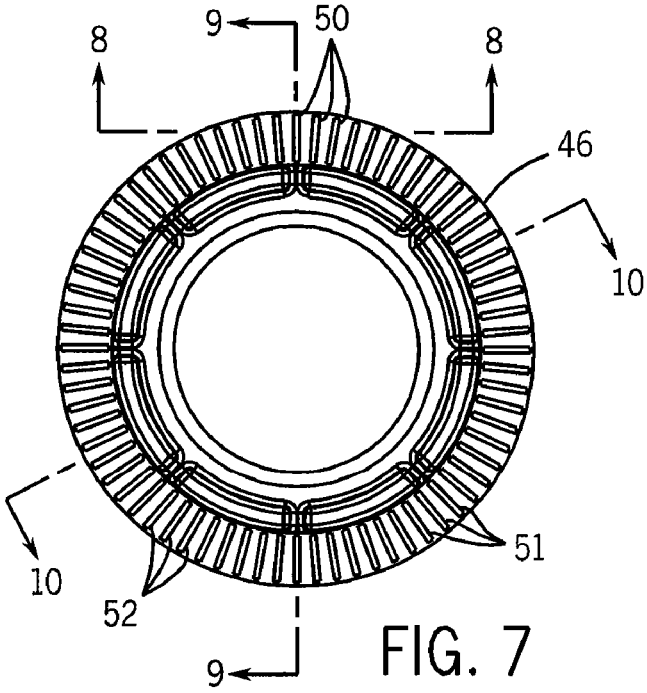
FIG. 7 is bottom view of the control knob of FIGS. 4 and 5.
Figure 9:
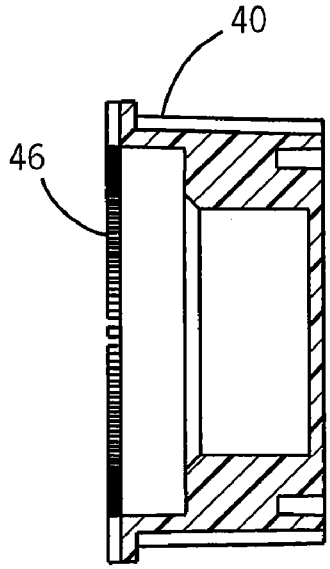
FIG. 9 is a sectional view taken in the plane indicated by line 9-9 in FIG. 7.
Figure 10:
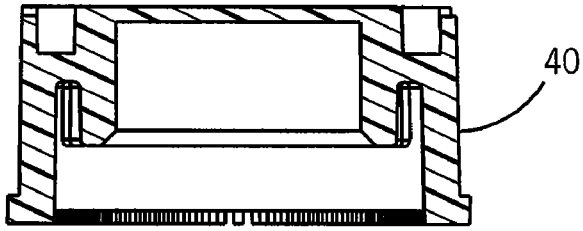
FIG. 10 is a sectional view taken in the plane indicated by line 10-10 in FIG. 7.

Referring to FIGS. 5, 6 and 7, the control knob 40 is provided with a mating connection to the disk body 38 by molded rigid teeth 46 formed around the circumference of the bottom face. The teeth 46 project downward to engage flexible teeth 47 formed on inserts 48, which are inserted and secured in grooves 49 in a hub 31 of the disk body 38. As seen in FIG. 7, the bottom of the control knob 40 has three segments 50, 51 and 52 of longer teeth 53 (FIG. 8) between shorter teeth 54 for intermeshing with teeth 47 from the inserts to hold the control knob 40 securely on the disk body 38. These segments 50, 51 and 52 also have recesses 554 (seen in FIG. 8) between the teeth 53. The knob is ratcheted into place on the teeth 47 on the disk body 38. This method of assembly prevents disassembly of the disk assembly in the field except to remove the shim 43 mentioned above.

In this machine 10, coins can be moved up to 4500 coins per minute along the coin track 24, and the coin moving disk assembly 23 made according to this construction will be more durable in this type of operation than the prior art design.

It will be apparent to those of ordinary skill in the art that modifications might be made to these details to arrive at other embodiments without departing from the spirit and scope of the invention.

We claim:

1. A coin moving disk assembly for moving coins across a coin sorting member in a coin handling machine, the coin sorting member having at least one opening to receive coins of various denominations, the coin moving disk assembly comprising:

an annular disk body having a groove portion positioned between an outer rim portion and a hub forming a central depression, the groove portion opening downwardly to receive a coin sensor assembly that projects upwardly into the groove portion, the outer rim portion having a cavity in a bottom surface; and a fin ring positioned in the cavity in the bottom surface, the fin ring comprising planar fingers extending downward and substantially perpendicular to the bottom surface of the rim portion, the fingers being spaced around the rim portion of the fin ring, each of the fingers having a base disposed in the cavity in the bottom surface of the disk body and each of the fingers having a bottom edge that is substantially narrower in width than the base of each finger, the bottom edge also being narrower in width than a diameter of a smallest size of coin to be processed, so that each finger can press on a portion of the coin to tip an edge portion of a coin into an opening for receiving the coin; and further comprising a substantially planar, annular shim disposed beneath a central opening in the hub and held in place by a removable adhesive, for removal by a user after an initial break-in period of operation to compensate for a gap between the bottom edges of the fingers and a surface of the coin sorting member resulting from an initial period of operation of the coin handling machine.

2. The coin moving disk assembly of claim 1, wherein the disk body is made of a glass-filled polycarbonate for stiffness.

3. The coin moving disk assembly of claim 1, wherein the fin ring is made of a polyurethane material.

4. The coin moving disk assembly of claim 1, wherein the coin moving disk assembly is made of a transparent material.

5. The coin moving disk assembly of claim 1, wherein the coin moving disk assembly is made of a semi-opaque, translucent material.

6. The coin moving disk assembly of claim 1, wherein the coin moving disk assembly is made of an opaque material.

7. The coin moving disk assembly of claim 1, further comprising a control knob portion that attaches within the central depression in the disk body.

8. The coin moving disk assembly of claim 7, wherein the control knob portion is secured within the central depression in the disk body by intermeshed teeth formed on the disk body and on the bottom of the control knob.

* * * * *